US006641765B2

(12) United States Patent
Cho et al.

(10) Patent No.: US 6,641,765 B2
(45) Date of Patent: Nov. 4, 2003

(54) POLYESTER MULTIFILAMENT YARN

(75) Inventors: Eun-Lai Cho, Seoul (KR); Duk-Ho Oh, Ulsan (KR); Song-Joo Choi, Ulsan (KR)

(73) Assignee: Hyosung Corporation, Seoul (KR)

( * ) Notice: Subject to any disclaimer, the term of this patent is extended or adjusted under 35 U.S.C. 154(b) by 0 days.

(21) Appl. No.: 09/972,001

(22) Filed: Oct. 4, 2001

(65) Prior Publication Data

US 2003/0059612 A1 Mar. 27, 2003

(30) Foreign Application Priority Data

May 10, 2001 (KR) ..... 2001-25458

(51) Int. Cl.[7] ..... D01D 5/12; D02G 3/00

(52) U.S. Cl. ..... 264/210.8; 428/375; 428/364; 428/395; 428/394

(58) Field of Search ..... 428/395, 394; 264/210.8

(56) References Cited

U.S. PATENT DOCUMENTS 4,101,525 A * 7/1978 Davis et al. ..... 528/309

* cited by examiner

*Primary Examiner*—Cynthia H. Kelly
*Assistant Examiner*—J. M Gray
(74) *Attorney, Agent, or Firm*—Pennie & Edmonds LLP

(57) ABSTRACT

Described in the present invention is a polyester multifilament yarn having a high modulus and low shrinkage which provides a treated cord having high tenacity and improved dimensional stability that can be advantageously employed as a fibrous reinforcement material of rubber products such as tires and belts.

2 Claims, 1 Drawing Sheet

POLYESTER MULTIFILAMENT YARN

FIELD OF THE INVENTION

The present invention relates to an improved polyester multifilament yarn having a high modulus and low shrinkage which is useful for the reinforcement of rubber products such as tires.

BACKGROUND OF THE INVENTION

Polyester yarns are widely utilized in various industrial rubber products such as tires, seat belts, conveyer velts, V-belts and hoses. In particular, treated cords manufactured by subjecting polyester yarns to latex- and heat-treatments have satisfactory dimensional stability and tenacity suitable for use as reinforcement tire cords.

U.S. Pat. No. 4,101,525 (Davis et al.) and U.S. Pat. No. 4,491,657 (Saito et al.) provide industrial polyester multifilament yarns having a high initial modulus and low shrinkage. However, such yarns provide reduced tenacity when they are converted to treated cords, as compared to conventional tire cords.

Accordingly, for the purpose of raising the tenacity of a polyester multifilament yarn, U.S. Pat. No. 4,690,866 (Kumakawa et al.) describes a method of making yarns using an ultra high viscosity polyester chip having an intrinsic viscosity (IV) of 1.2 or greater. The use of such a high IV polyester chip causes an increase in the spinning tension, which enhances both the orientation of the undrawn yarn and the formation of tie chains among crystals, thereby providing yarns of high tenacity, when converted to treated cords. However, such a high IV chip tends to exhibit a significant IV difference between its core and surface section, which results in excessive filament cuts during melt-spinning and drawing, yielding yarns having poor mechanical quality and appearance. In addition, as a high IV chip must be melt-spun at a high temperature, it tends to undergo partial decomposition and hydrolysis, giving yarns having an IV much lower than that of the original chip.

SUMMARY OF THE INVENTION

Accordingly, it is an object of the present invention to provide a polyester multifilament yarn having excellent properties which is capable of providing a treated cord having high tenacity and improved dimensional stability.

In accordance with one aspect of the present invention, there is provided a polyester multifilament yarn prepared by a method comprising the steps of: (A) melt-spinning a solid-phase polymerized polyester chip, composed of 90 mol % or more of ethylene terephthalate units as the recurring unit and having an intrinsic viscosity of 1.05 to 1.13, through a spinneret at a temperature ranging from 290 to 298° C. to form a molten spun yarn, (B) rapid-cooling and solidifying the spun yarn by passing it through a solidification zone, (C) withdrawing the solidified yarn at such a rate that an undrawn yarn having a birefringence of 0.06 to 0.09 and a density of 1.360 to 1.375 is formed, and (D) hot-drawing the yarn to a total draw ratio of 1.5 to 2.5; said yarn having (1) a unit filament thickness of 2.5 to 3.5 denier, (2) an IV of 0.94 to 1.00, (3) a DEG(diethylene glycol) content of 0.65 to 0.9 weight %, (4) a CEG(carboxyl end group) content of 23 eq./$10^6$ g or less, (5) a tenacity of 7.5 to 8.5 g/d, (6) an elongation of 13.0 to 16.0%, (7) a shrinkage of 4.0 to 7.0%, and (8) a silk factor (tenacity(g/d)×√ elongation at break) of at least 27.

BRIEF DESCRIPTION OF THE DRAWINGS

The above and other objects and features of the present invention will become apparent from the following description of the invention, when taken in conjunction with the accompanying drawing, FIG. 1, which shows a schematic diagram of the process for the preparation of a polyester multifilament yarn in accordance with one embodiment of the present invention.

Figure 1:
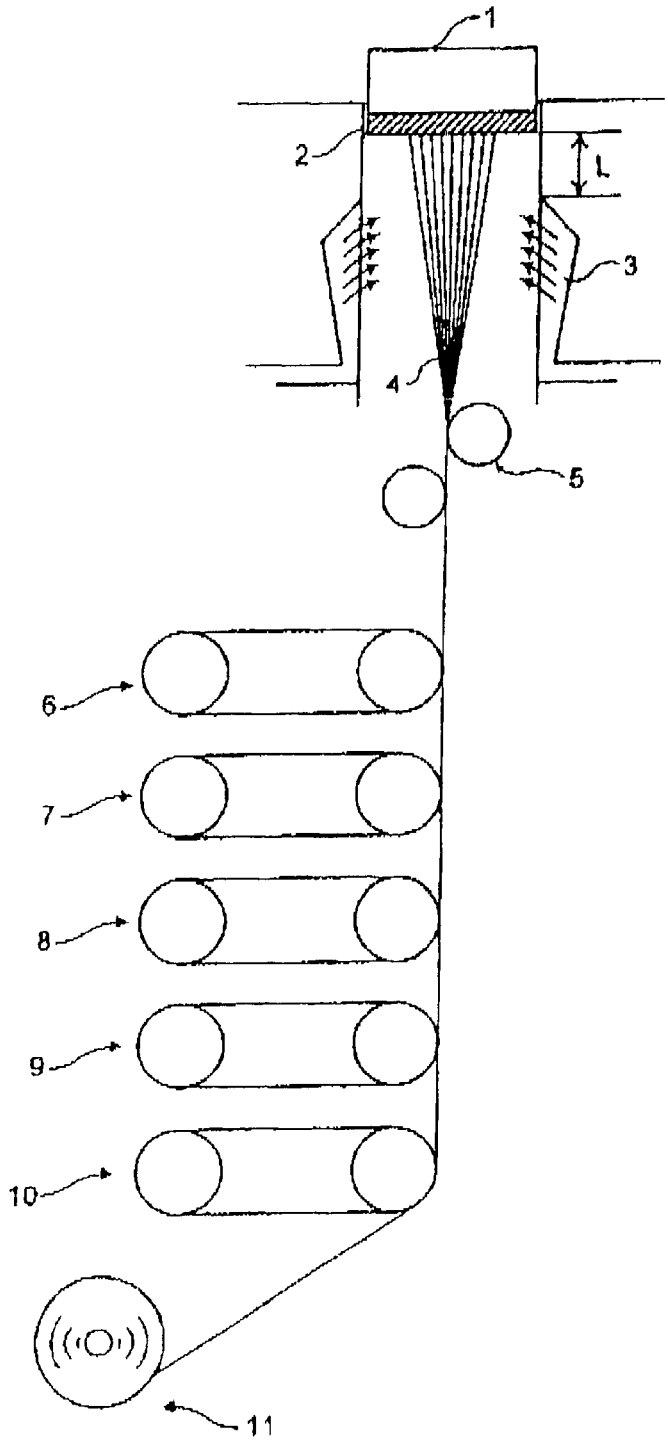

| | |
|---|---|
| 1: pack | 2: nozzles |
| 3: cooling zone | 4: spun yarns |
| L: hood length | 5: oil-feeding roller |
| 6: withdrawing roller | 7, 8, 9 and 10: drawing rollers |
| 11: final drawn yarns (original yarns) | |

DETAILED DESCRIPTION OF THE INVENTION

The polyester chip which is employed in the present invention contains at least 90 mol % of ethylene terephthalate units as the recurring unit. In a preferred embodiment, the polyester chip is composed essentially of polyethylene terephthalate. Alternatively, the polyester chip may incorporate, as copolymer units, minor amounts of units derived from one or more ester-forming ingredients other than ethylene glycol and terephthalic acid or its derivatives.

The inventive polyester chip may be prepared from a raw chip having a low IV by solid-phase polymerization and it has an IV of 1.05 to 1.13 and a moisture content of 30 ppm or below. The raw chip is prepared by melt-polymerizing raw materials using an Antimony compound as the main polymerization catalyst. When the IV of the chip is less than 1.05, the drawn yarn possesses an insufficient IV and the cords made therefrom have low tenacity, while when the IV is more than 1.13, the spinning tension becomes excessively high and the spun yarn becomes nonuniform. This results in frequent filament cuts during melt-spinning and drawing. In case the moisture content of the chip is higher than 30 ppm, hydrolysis occurs during melt-spinning. In addition, the Antimony compound used as a polymerization catalyst may be added such that the amount of antimony remaining in the polymer is in the range of 200 to 300 ppm. When the amount of the catalyst used corresponds to a residual antimony content of less than 200 ppm, an accelerated polymerization reaction cannot be achieved, while if the value is more than 300 ppm, the excessive amount of the catalyst induces an undesirable increase of the pack pressure and also contaminates the nozzles.

The method for preparing the polyester multifilament yarn of the present invention is characterized by melt-extruding a suitable polyester polymer having an appropriate IV at a relatively low temperature so as not to degrade the polymer during the melt-spinning, lowering the denier of the drawn yarn in order to enhance the cooling efficiency of the spun yarn, and optimizing the spinning speed to impart desired birefringence to the undrawn yarn.

FIG. 1 represents a schematic diagram of the process for the preparation of a polyester multifilament yarn in accordance with one embodiment of the present invention.

In step (A), the polyester chip is melt-spun at a relatively low temperature ranging from 290 to 298° C. to prevent viscosity decrease caused by heat-decomposition and hydrolysis, through a spinneret having pack (1) and nozzles (2) to form a molten spun yarn. In this step, the fineness of the spun yarn is controlled such that it falls in the range of 2.5 to 3.5 denier (conventional one is in the range of 4 to 6 denier).

In step (B), the spun yarn (4) formed in step (A) traverses a solidification zone comprising a delayed cooling zone (or a heating zone corresponding to hood length (L)) located just below the nozzles (2) and a cooling zone (3) adjacent said delayed cooling zone. The delayed cooling zone, preferably having a length of 140 to 220 mm, comprises a gaseous atmosphere heated at a temperature of 250 to 380° C. and a cooling air stream is introduced in the cooling zone to quench and solidify the fine spun yarn having enhanced orientation and tie chains. Further, the solidified spun yarn (4) may be oiled to an amount of 0.5 to 1.0% by passing through an oil-feeding roller (5).

In step (C), the solidified yarn is withdrawn with a withdrawing roller (6) at a speed in the range of 2500 to 2800 m/min. to form an undrawn yarn having a birefringence of 0.06 to 0.09 and a density of 1.360 to 1.375. When the birefringence of the undrawn yarn is below 0.06, the formation of tie chains is not satisfactory, giving a treated cord having poor tenacity and dimensional stability, while when the value is more than 0.09, excessive crystallization occurs, which lowers the tenacity of the yarn. In addition, the density which reflects the degree of orientation and crystallization of the undrawn yarn is preferably in the range of 1.360 to 1.375. Otherwise, problems similar to those mentioned in relation with the birefringence occur.

In step (D), the yarn exiting the withdrawing roller (6) is hot-drawn to a total draw ratio of 1.5 to 2.5, preferably 1.8 to 2.3 with a series of drawing roller (7, 8, 9 and 10), i.e., by a spin draw process to form a final drawn yarn (11). As described above, the fineness of the final drawn yarn is controlled in the range of 2.5 to 3.5 denier, otherwise, excessive filament cuts occur due to nonuniformity of the undrawn yarn or unsatisfactory tie chain formation due to delayed cooling. At this stage, the drawn yarn may be heat-set at a temperature of 190 to 240° C. and relaxed to an extent of 2 to 5%, in accordance with a conventional method.

The polyester multifilament yarn of the present invention, prepared by the above method, has the combined properties of (1) a unit filament thickness of 2.5 to 3.5 denier, (2) an intrinsic viscosity of 0.94 to 1.00, (3) a DEG(diethylene glycol) content of 0.65 to 0.9 weight %, (4) a CEG(carboxyl end group) content of 23 eq./$10^6$ g or less, (5) a tenacity of 7.5 to 8.5 g/d, (6) an elongation of 13.0 to 16.0%, (7) a shrinkage of 4.0 to 7.0%, and (8) a silk factor (tenacity(g/d)×√ elongation at break) of at least 27.

The inventive drawn yarn thus prepared may be converted to a treated cord by a conventional process. For example, 2 strands of 1500 denier drawn yarns are plied and cabled with 390 turns/m (standard twist number for general polyester treated cord) to prepare a cord yarn; the cord yarn is subjected to a conventional adhesive coating (e.g., isocyanate, epoxy resin, parachlorophenol resin and resorcinol-formaline-latex (RFL)); dried and stretched at a temperature of 130 to 160° C. for a period of 150 to 200 seconds at a stretch ratio of 1.0 to 4.0%; heat-set and stretched at a temperature of 235 to 245° C. for a period of 45 to 80 seconds at a stretch ratio of 2.0 to 8.0%; the cord yarn is again subjected to a conventional adhesive coating (e.g., RFL); dried at a temperature of 140 to 240° C. for a period of 90 to 120 seconds; and then, heat-set at a temperature of 235 to 245° C. for a period of 45 to 80 seconds at a stretch ratio of −4.0 to 2.0%, to obtain a treated cord having a good dimensional stability, represented by the sum of $E_{2.25}$ (elongation at 2.25 g/d load) and FS (free shrinkage) being 6.0 to 6.7%, and a tenacity of 6.7 to 7.2 g/d.

As described above, the inventive polyester multifilament yarn having a high modulus and low shrinkage provides a treated cord having high tenacity and improved dimensional stability that can be advantageously employed as a fibrous reinforcement material of rubber products such as tires and belts.

The following Examples are given for the purpose of illustration only, and are not intended to limit the scope of the invention. In the Examples and Comparative Examples, the characteristics of the yarns and treated cords produced were evaluated in accordance with the following methods.

1. Intrinsic Viscosity (IV)

0.1 g of a sample was dissolved in a solvent, a mixture of phenol and 1,1,2,3-tetrachloroethane (60/40 by weight), to a concentration of 0.4 g/100 ml. The solution was put in Ubbelohde viscometer and kept in a 30° C. water bath for 10 minutes. The flow time of the solution as well as that of the solvent were measured and RV and IV values were calculated based on the following formulae:

$$RV = \text{flow time of the solution/flow time of the solvent} \quad (1)$$

$$IV = \tfrac{1}{4} \times (RV - 1)/C + \tfrac{3}{4} \times (\ln RV/C) \quad (2)$$

wherein, C is concentration (g/100 ml) of the sample in the solution.

2. CEG Content

In accordance with ASTM D 664 and D 4094, 0.2 g of a sample was placed in a 50 ml flask and 20 ml of benzyl alcohol was added thereto and heated to 180° C. to dissolve the sample completely. The solution was cooled, and, when the temperature reached 135° C., 5~6 drops of phenolphthalein were added to the solution and titrated with 0.02N KOH to determine the content of CEG (COOH eq./$10^6$ g) by the following formula:

$$CEG = (A - B) \times 20 \times 1/W \quad (3)$$

wherein, A and B are KOH titrations (ml) for the sample solution and a blank, respectively, and W is weight (g) of the sample.

3. DEG Content 0.1 g of a sample was placed in a 50 ml flask and 3 ml of monoethanol amine was added thereto, heated and dissolved the sample completely. The solution was then cooled, and, when the temperature reached 100° C., the solution was mixed with 0.005 g of 1,6-hexandiol in 20 ml of methanol and neutralized with 10 g of terephthalic acid. The resulting neutralized solution was filtered and the filtrate was subjected to Gas Chromatography (Shimadzu GC analyzer) to determine the content of DEG (weight %).

4. Tenacity

The tenacity of a sample was determined in accordance with ASTM D 885 at a sample length of 250 mm, a tensile speed of 300 mm/min. and 80 turns/m under a standard atmosphere (20° C., 65% relative humidity), using Instron 5565 (Instron Co., Ltd, USA).

5. Density and Crystallinity

The density (ρ) of a sample was determined using a xylene/carbon tetrachloride density gradient column at 23° C. The gradient column was prepared and calibrated according to ASTM D 1505 at a density range of 1.34 to 1.41 g/$cm^3$. Crystallinity (%) was then calculated from the following formula:

$$\text{Crystallinity} = \rho c/\rho \times (\rho/\rho a)/(\rho c - \rho a) \quad (4)$$

wherein, ρ is the measured density of the sample (g/cm$^3$), and ρ c and ρ a are theoretical densities of 100% crystalline and amorphous phases, i.e., 1.455 and 1.335 g/cm$^3$, respectively.

6. Birefringence

The birefringence of a sample was determined using a polarizing light microscope equipped with a Berek compensator.

7. Crystalline Orientation Factor (fc)

A sample was fixed to a holder at a constant thickness of about 0.5 mm, the holder was positioned vertically, and subjected to an X-ray diffraction analysis at a power of 35 KV and a current of 20 mA. Then, the counter was fixed on the (010) peak thereof, and carried out a 360° azimuthal scan to determine the full width at half maximum (FWHM). Crystalline orientation factor (fc) was then calculated from the following formula:

$$fc=180°-FWHM(\text{aver.})/180° \quad (5)$$

8. Amorphous Orientation Factor (fa)

Amorphous orientation factor (fc) was calculated from the following formula:

$$fa=(\Delta n-fc\cdot Xc\cdot\Delta nc)/(1-Xc)\cdot\Delta na \quad (6)$$

wherein, Δn is a birefringence, fc is a crystalline orientation factor, Xc is a crystallinity, and Δnc and Δna are intrinsic birefringences of crystals and non-crystals, i.e., 0.220 and 0.275, respectively.

9. Shrinkage

A sample was kept under a standard atmosphere (20° C., 65% relative humidity) for 24 hours and then its length ($L_0$) at 0.1 g/d load was measured. Alternatively, a sample was kept in a dry oven of 150° C. under a non-tension condition for 30 minutes and left outdoors for 4 hours, and then its length (L) at 0.1 g/d load was measured. Shrinkage (%) was calculated from the following formula:

$$\Delta S=(L_0-L)/L_0\times 100 \quad (7)$$

10. Elongation at Specific Load

As an elongation at specific load, the elongation at 4.5 g/d load was measured on the S—S tenacity curve for an original yarn sample, and the elongation at 2.25 g/d load, for a treated cord sample.

11. Dimensional Stability

The dimensional stability (%) of a treated cord, which is related to the tire sidewall indentations (SWI) and tire handling properties, is determined by the modulus at a given shrinkage, and the sum $E_{2.25}$ (elongaion at 2.25 g/d load)+FS (free shrinkage) is a good indicator of the dimensional stability for a treated cord processed under a particular heat-treatment condition, and the lower the sum, the better the dimensional stability.

EXAMPLE 1

A solid-phase polymerization was conducted using an antimony compound as a polymerization catalyst to obtain a polyethylene terephthalate chip having an IV of 1.1, a moisture content of 20 ppm, and an antimony content of 220 ppm. The chip was passed through an extender and melt-spun at 288° C. at a rate of 900 g/min. in such a manner that the unit filament thickness of the final drawn yarn became 3.0 denier. Then, the spun yarns were solidified by passing successively through the 130 mm-long delayed cooling zone just below the nozzles and the 530 mm-long cooling zone where a cooling air of 20° C. was blown at a rate of 0.5 m/sec (see FIG. 1). The solidified yarns were oiled and withdrawn at a rate of 2600 m/min to form undrawn yarns, which were drawn in three stages to a total draw ratio of 2.15, heat-set at 230° C., relaxed to 2% and wound to form 1500 denier final drawn yarns (original yarns).

2 strands of the original yarns thus obtained were plied and cabled with 390 turns/m to prepare a cord yarn. The cord yarn was dipped successively in parachlorophenol resin and then in RFL, dried and stretched at 150° C. for 150 seconds at a stretch ratio of 2.0%, heat-set and stretched at 240° C. for 60 seconds at a stretch ratio of 8.0%, dipped in RFL, dried at a temperature of 240° C. for a period of 100 seconds, and then, heat-set at a temperature of 240° C. for 60 seconds at a stretch ratio of −4.0%, to obtain a treated cord.

The properties of the drawn yarn and the treated cord thus obtained were determined and the results are showed in Table 1.

EXAMPLES 2 to 7 and Comparative Examples 1 to 7

The procedures of Example 1 were repeated except for changing the IV of the chip, spinning temperature, spinning speed, unit filament fineness, birefringence or density related to the orientation of an undrawn yarn sample, or the total draw ratio as represented in Table 1 to obtain various drawn yarns and treated cords.

The properties of drawn yarns and treated cords thus obtained were determined and the results are showed in Table 1.

TABLE 1

| | | | | | Total | Undrawn yarn | | Drawn yarn | | | | | | | | | |
|---|---|---|---|---|---|---|---|---|---|---|---|---|---|---|---|---|---|
| Item | Chip IV | Spin. temp. (° C.) | Spin. speed (m/min.) | Fineness | draw ratio * | Bire-frin-gence | den-sity | IV | Ten-acity (g/d) | Med elong. (%) | Elong. (%) | Shrinkage (%) | fa | CEG (eq./ $10^6$ g) | DEG (w %) | Silk factor |
| Ex. 1 | 1.10 | 293 | 2600 | 3.0 | 2.15 | 0.060 | 1.361 | 0.96 | 7.7 | 5.7 | 13.7 | 4.9 | 0.773 | 19 | 0.80 | 28.5 |
| Ex. 2 | 1.07 | 290 | 2550 | 3.5 | 2.18 | 0.065 | 1.362 | 0.94 | 7.9 | 5.4 | 13.3 | 5.5 | 0.778 | 19 | 0.80 | 28.8 |
| Ex. 3 | 1.07 | 290 | 2550 | 3.0 | 2.16 | 0.068 | 1.363 | 0.94 | 7.9 | 5.3 | 13.2 | 5.5 | 0.775 | 19 | 0.80 | 28.7 |
| Ex. 4 | 1.07 | 290 | 2550 | 3.0 | 2.16 | 0.070 | 1.365 | 0.94 | 7.7 | 5.3 | 13.5 | 5.2 | 0.772 | 19 | 0.80 | 28.3 |
| Ex. 5 | 1.07 | 290 | 2550 | 2.5 | 2.10 | 0.080 | 1.368 | 0.94 | 7.6 | 5.3 | 13.2 | 5.0 | 0.770 | 19 | 0.80 | 27.6 |
| Ex. 6 | 1.10 | 293 | 2500 | 3.5 | 2.12 | 0.070 | 1.365 | 0.96 | 7.8 | 5.6 | 13.5 | 5.8 | 0.795 | 17 | 0.80 | 28.7 |
| Ex. 7 | 1.10 | 293 | 2700 | 3.0 | 2.05 | 0.090 | 1.370 | 0.96 | 7.5 | 5.6 | 14.0 | 5.2 | 0.770 | 17 | 0.80 | 28.1 |
| Comp. Ex. 1 | 1.04 | 288 | 2500 | 6.0 | 2.25 | 0.050 | 1.355 | 0.92 | 7.7 | 5.7 | 13.5 | 7.5 | 0.798 | 20 | 0.80 | 28.3 |
| Comp. | 1.07 | 290 | 2450 | 6.0 | 2.20 | 0.060 | 1.358 | 0.94 | 7.9 | 5.6 | 14.0 | 7.2 | 0.785 | 19 | 0.80 | 29.6 |

TABLE 1-continued

| | | | | | | | | | | | | | | | | |
|---|---|---|---|---|---|---|---|---|---|---|---|---|---|---|---|---|
| Ex. 2 | | | | | | | | | | | | | | | | |
| Comp. Ex. 3 | 1.07 | 290 | 2450 | 3.9 | 2.18 | 0.060 | 1.360 | 0.94 | 7.9 | 5.4 | 13.5 | 7.2 | 0.778 | 19 | 0.80 | 29.0 |
| Comp. Ex. 4 | 1.07 | 290 | 2450 | 2.0 | 2.02 | 0.070 | 1.366 | 0.94 | 7.5 | 5.2 | 12.0 | 5.0 | 0.770 | 19 | 0.80 | 26.0 |
| Comp. Ex. 5 | 1.10 | 293 | 2450 | 3.9 | 2.14 | 0.070 | 1.358 | 0.96 | 7.8 | 5.2 | 13.3 | 6.8 | 0.774 | 17 | 0.80 | 28.4 |
| Comp. Ex. 6 | 1.10 | 293 | 2800 | 3.0 | 1.98 | 0.100 | 1.378 | 0.96 | 7.3 | 5.6 | 14.0 | 5.0 | 0.765 | 17 | 0.80 | 27.3 |
| Comp. Ex. 7 | 1.14 | 298 | 2450 | 3.0 | 2.10 | 0.070 | 1.368 | 1.01 | 7.5 | 5.6 | 14.0 | 6.8 | 0.785 | 17 | 0.80 | 28.1 |

| | Treated cord | | | | |
|---|---|---|---|---|---|
| Item | Tenacity (g/d) | Med. elong. (%) | Shrinkage (%) | $E_{2.25}$ + FS (%) | Remark |
| Ex. 1 | 6.7 | 4.0 | 2.5 | 6.5 | |
| Ex. 2 | 6.7 | 4.0 | 2.6 | 6.6 | |
| Ex. 3 | 6.8 | 4.0 | 2.6 | 6.6 | |
| Ex. 4 | 6.8 | 4.0 | 2.5 | 6.5 | |
| Ex. 5 | 6.7 | 4.0 | 2.3 | 6.3 | |
| Ex. 6 | 6.8 | 4.0 | 2.5 | 6.5 | |
| Ex. 7 | 6.7 | 4.0 | 2.2 | 6.2 | |
| Comp. Ex. 1 | 6.6 | 4.0 | 3.9 | 7.9 | |
| Comp. Ex. 2 | 6.7 | 4.0 | 3.1 | 7.1 | |
| Comp. Ex. 3 | 6.7 | 4.0 | 2.8 | 7.0 | |
| Comp. Ex. 4 | | | | | xx |
| Comp. Ex. 5 | 6.7 | 4.0 | 2.8 | 6.8 | |
| Comp. Ex. 6 | 6.5 | 4.0 | 2.2 | 6.2 | |
| Comp. Ex. 7 | 6.7 | 4.0 | 2.9 | 6.9 | |

xx: Very poor appearance and it was impossible to prepare treated cord
*: 97% level of draw ratio in which a taking-up is maintained for 5 min.

As described above, the polyester multifilament yarn of the present invention has improved properties such as a high modulus and low shrinkage, which provides a treated cord having high tenacity and improved dimensional stability that can be advantageously employed as a fibrous reinforcement material of rubber products such as tires and belts.

While the embodiments of the subject invention have been described and illustrated, it is obvious that various changes and modifications can be made therein without departing from the spirit of the present invention which should be limited only by the scope of the appended claims.

What is claimed is:

1. A method of preparing a polyester multifilament yarn, which comprises the steps of:

(A) melt-spinning a solid-phase polymerized polyester chip, composed of 90 mol % or more of ethylene terephthalate units as the recurring unit and having an intrinsic viscosity of 1.05 to 1.13, through a spinneret at a temperature ranging from 290 to 298° C. to form a molten spun yarn, (B) rapid-cooling and solidifying the spun yarn by passing it through a solidification zone, (C) withdrawing the solidified yarn at such a rate that an undrawn yarn having a birefringence of 0.06 to 0.09 and a density of 1.360 to 1.375 is formed, and (D) hot-drawing the yarn to a total draw ratio of 1.5 to 2.5; so as for said yarn to have (1) a unit filament thickness of 2.5 to 3.5 denier, (2) an intrinsic viscosity of 0.94 to 1.00, (3) a DEG(diethylene glycol) content of 0.65 to 0.9 weight %, (4) a CEG(carboxyl end group) content of 23 eq./$10^6$ g or less, (5) a tenacity of 7.5 to 8.5 g/d, (6) an elongation of 13.0 to 16.0%, (7) a shrinkage of 4.0 to 7.0%, and (8) a silk factor (tenacity(g/d)×$\sqrt{\text{elongation at break}}$) of at least 27.

2. The method of claim 1, wherein the rate in step (C) is in the range of 2500 to 2800 m/min.

* * * * *